US005950389A

United States Patent [19]

Porter

[11] Patent Number: 5,950,389

[45] Date of Patent: Sep. 14, 1999

[54] SPLINES FOR JOINING PANELS

[76] Inventor: William H. Porter, P.O. Box 249, Saugatuck, Mich. 49453

[21] Appl. No.: 08/674,457

[22] Filed: Jul. 2, 1996

[51] Int. Cl.[6] ..... E04B 2/58; E04B 1/38

[52] U.S. Cl. ..... 52/586.1; 52/309.8; 52/582.1; 52/417; 52/464; 403/359

[58] Field of Search ..... 52/309.7, 309.8, 52/309.9, 309.11, 309.16, 586.1, 585.1, 582.1, 582.2, 584.1, 588.1, 376, 417, 464, 586.2; 403/359

[56] References Cited

U.S. PATENT DOCUMENTS

| | | | |
|---|---|---|---|
| 2,875,478 | 3/1959 | Andre | 52/586.1 |
| 3,313,073 | 4/1967 | Mathews | 52/309 |
| 3,367,076 | 2/1968 | O'Brien | 52/394 |
| 3,667,180 | 6/1972 | Tischuk | 52/309 |
| 3,742,672 | 7/1973 | Schaeufele | 52/594 |
| 3,886,699 | 6/1975 | Bergmann, Jr. | 52/90 |
| 4,037,377 | 7/1977 | Howell et al. | 52/309.9 |
| 4,068,437 | 1/1978 | Byxbe et al. | 52/464 |
| 4,100,710 | 7/1978 | Kowallik | 52/309.9 |
| 4,169,688 | 10/1979 | Toshio | 52/586.1 X |
| 4,170,859 | 10/1979 | Counihan | 52/586.1 X |
| 4,443,988 | 4/1984 | Coutu, Sr. | 52/309.9 |
| 4,575,981 | 3/1986 | Porter | 52/309.9 |
| 4,671,038 | 6/1987 | Porter | 52/586.1 |
| 5,014,476 | 5/1991 | Leslie et al. | 52/220 |
| 5,022,208 | 6/1991 | Ehrat et al. | 52/586 |
| 5,058,333 | 10/1991 | Schwartz | 52/586.2 X |
| 5,062,250 | 11/1991 | Buzzella | 52/586.2 |
| 5,497,589 | 3/1996 | Porter | 52/309.7 |
| 5,524,394 | 6/1996 | Szabo, Sr. et al. | 52/586.1 X |

FOREIGN PATENT DOCUMENTS

| | | |
|---|---|---|
| 2444762 | 7/1980 | France . |
| 1066701 | 4/1967 | United Kingdom . |

*Primary Examiner*—Christopher Kent
*Assistant Examiner*—Yvonne Horton-Richardson
*Attorney, Agent, or Firm*—Emrich & Dithmar

[57] ABSTRACT

A pair of splines each in the form of a thin metal strip are inserted into respective grooves or slots adjacent the opposed facings of a pair of structural panels. Each panel further includes an insulating foam core disposed between and attached to the opposed pair of facings. An adhesive applied to the metal splines bonds the splines to each panel and securely connects the two panels along respective abutting edges. In one embodiment, each metal strip is provided with opposed turned-in edges which function as hooks for engaging each panel's foam core and preventing separation of the two panels, particularly during curing of the adhesive. In another embodiment, each spline further includes a foam insulating strip about which the spline's metal strip is substantially wrapped for providing a thermal barrier at the panel juncture. In yet another embodiment, the spline's metal strip is provided with an irregular surface such as grooved or embossed for more uniform application of the adhesive on the metal strip and a stronger bond between the spline and adjacent panels. By bonding the internal splines directly to each panel's outer facing, an inner component in the panel juncture for additional strength is not required and the routing of electrical chases through the panel juncture is simplified.

10 Claims, 2 Drawing Sheets

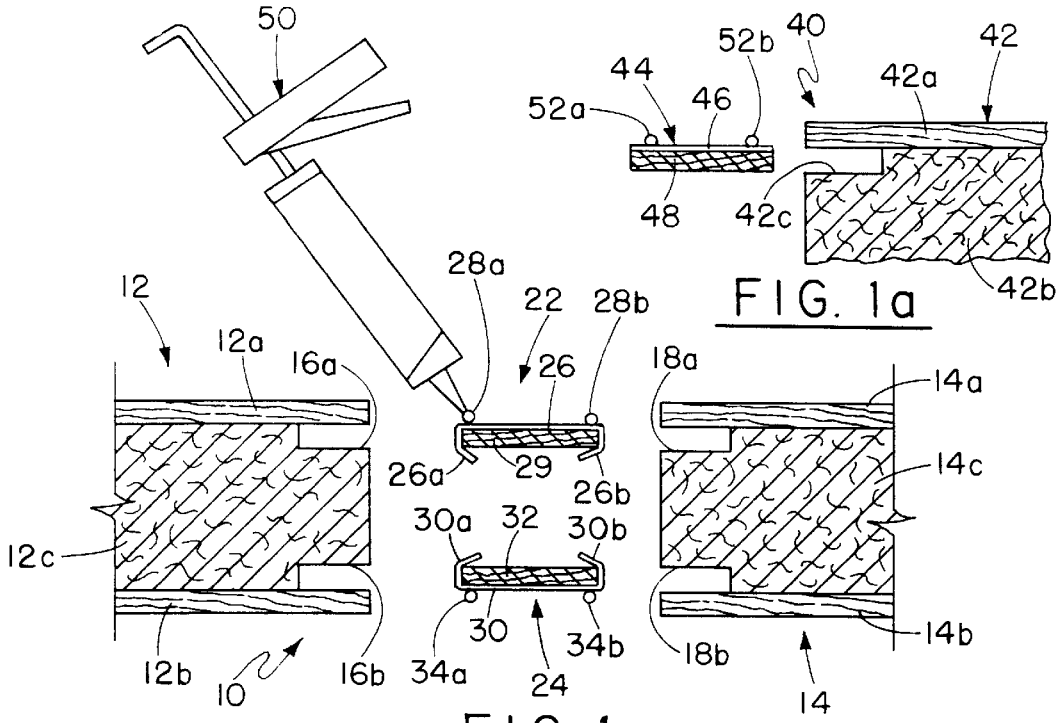
FIG. 1
FIG. 1a
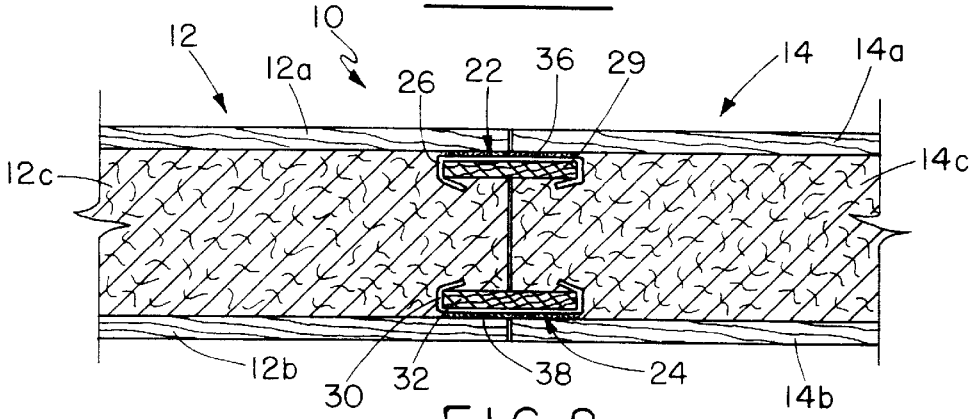
FIG. 2
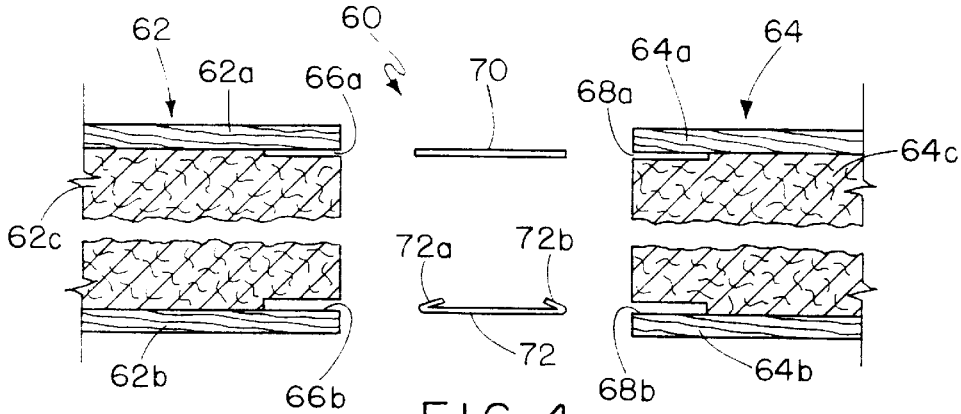
FIG. 4

SPLINES FOR JOINING PANELS

FIELD OF THE INVENTION

This invention relates generally to structural panels for buildings and is particularly directed to an improved joining arrangement for structural panels having opposed facings and an inner foam core involving the use of metal splines disposed in and attached to the foam core and affixed to each of the opposed facings of adjacent panels.

BACKGROUND OF THE INVENTION

A popular construction approach gaining increased acceptance uses Structural Insulated Panels (SIPs). SIP construction employs a basic structural unit comprising two rigid faces on either side of a light insulated foam core. This approach requires good adhesion of the faces to the core to form a high strength structural I-beam. Panels of this type are generally joined by means of lumber and nails, but are increasingly connected using steel studs rather than the conventional 2× dimensional lumber approach. The junctures of such panels typically employ a lumber spline with nails and screws for joining. One example of this panel joining approach is disclosed in U.S. Pat. No. 4,443,988, issued Apr. 24, 1984.

In order to accommodate electrical wiring chases extending between adjacent panels, the lumber spline must be configured prior to assembly to accommodate the wire chase. For example, holes in the lumber splines which are aligned with the wiring chases in each foam core must be pre-drilled into the spline generally at the factory. This requires matching each panel juncture with a pre-drilled lumber spline and complicates assembly of the building structure. As shown in the aforementioned patent, each spline is inserted in a respective slot formed by the panel's foam core and one of the opposed facings. An adhesive may be applied to the spline prior to insertion in one of the slots. Because of the tight fit between the spline and its associated slot, the adhesive is generally not uniformly applied to the interface between the spline and connected panel, resulting in reduced bonding strength between two adjacent panels. In addition, there is a tendency for two adjacent panels to pull apart while the adhesive is curing resulting in a less secure connection between the panels. Finally, while metal splines may be capable of providing a high strength connection between adjacent panels, metals have high thermal conductivity and result in energy loss when extending between the inner and outer faces of a panel which forms an outer wall of the structure.

The present invention addresses the aforementioned limitations of the prior art by providing an improved panel joining arrangement for structural panels having opposed outer facings and an inner insulating foam core. The inventive panel joining arrangement employs a pair of spaced metal splines, each bonded to the outer facings of adjacent panels and separated by an insulating core material.

OBJECTS AND SUMMARY OF THE INVENTION

Accordingly, it is an object of the present invention to provide a double spline arrangement for joining a pair of structural insulated panels.

It is another object of the present invention to provide an embossed or grooved metal spline for receiving an adhesive deposit for uniformly applying the adhesive to adjacent structural panels for more securely connecting the panels.

Yet another object of the present invention is to connect adjacent flat structural panels using a double spline arrangement employing an adhesive deposited on the splines as well as a double hook arrangement on each spline for securely engaging the foam core of each panel and maintaining secure coupling between the panels particularly during curing of the adhesive.

A further object of the present invention is to provide an arrangement for securely connecting a pair of flat structural panels each having opposed outer facings and an inner foam core in a manner which facilitates running electrical wiring chases between the connected panels.

This invention contemplates an arrangement for joining structural panels comprising: first and second structural panels each having respective first and second opposed facings and an insulating foam core attached to and disposed between the facings, each of the structural panels further including respective first and second slots in an edge thereof formed between the insulating foam core and a facing of a panel; first and second metal splines each inserted in a respective slot and engaging a facing of each of the first and second structural panels; and an adhesive for bonding each of the first and second metal splines to an outer facing of each of the first and second structural panels.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 1 is an exploded partial sectional view of a pair of insulated structural panels connected together by means of the double spline arrangement of the present invention;

FIG. 1*a* is an exploded partial sectional view of a structural panel and spline combination in accordance with another embodiment of the present invention;

FIG. 2 is a partial sectional view showing the pair of structural panels and spline combination of FIG. 1 in assembled form;

FIG. 4 is an exploded partial sectional view showing another spline connecting arrangement in accordance with the principles of the present invention;

DETAILED DESCRIPTION OF THE PREFERRED EMBODIMENTS

Figure 3:
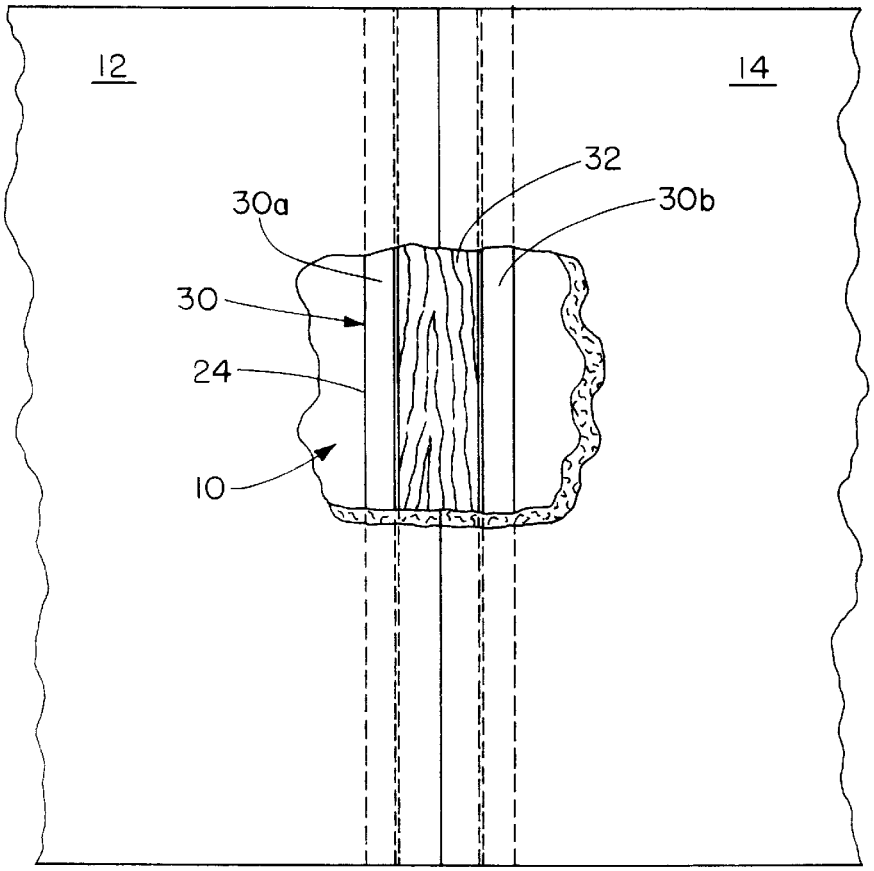
FIG. 3 is a partially cut-away view of the pair of panels shown in FIG. 2 connected together using the spline arrangement of the present invention.

Referring to FIGS. 1 and 2, there are respectively shown exploded and assembled sectional views of a panel joining arrangement 10 in accordance with the principles of the present invention. FIG. 3 is a partially cut-away plan view of the panel joining arrangement 10 shown in FIGS. 1 and 2.

The panel joining arrangement 10 securely couples together first and second generally planar structural panels 12 and 14. The first and second panels 12, 14 respectively include outer and inner facings 12*a*, 12*b* and 14*a*, 14*b*. First and second panels 12, 14 further include respective foam cores 12*c* and 14*c* disposed between and coupled to the respective outer and inner facings of the panel. The terms "outer" and "inner" are used merely to distinguish the two opposed surfaces of the panel and are not intended to designate which of the aforementioned facings is disposed on an outer portion or an inner portion of the building in which the structural panel is used. Bonding between each foam core and its associated pair of outer and inner facings is accomplished by the adhesive characteristic of the foam core during curing and/or by means of a conventional adhesive such as an epoxy cement or glue applied to the opposed surfaces of the foam core and facing.

Opposed edges of the first panel 12 are each provided with a pair of slots as shown for the case of slots 16*a* and 16*b* in the figures. Similarly, opposed edges of the second panel 14 are provided with a pair of slots in opposed edges of the panel as shown for the case of slots 18*a* and 18*b*. Each of the aforementioned slots is formed by respective adjacent edge portions of the panel's foam core and one of its facings. Thus, slots 16*a* and 16*b* in the first panel 12 are respectively formed by the panel's foam core 12 and its outer and inner facings 12*a* and 12*b*. Similarly, slots 18*a* and 18*b* in the second panel 14 are respectively formed by its foam core 14*c* and its outer and inner facings 14*a* and 14*b*. Each of the first and second panels 12, 14 is generally planar and rectangular in shape, with each of the aforementioned slots extending the length of the panel.

Each of the aforementioned slots in the first and second panels 12, 14 is adapted to receive an end portion of a connecting spline. Thus, slots 16*a* and 18*a* in the first and second panels 14 and 16 when aligned is adapted to receive respective ends of an outer spline 22. Similarly, each of slots 16*b* and 18*b* when aligned is adapted to receive in tight fitting engagement a respective end of an inner spline 24.

The outer and inner splines 22, 24 extend substantially the entire length of the first and second panels 12, 14. Outer spline 22 includes a metal strip 26 wrapped around and at least partially enclosing a foam core 29. Opposed ends of metal strip 26 along its entire length are formed in the shape of hooks 26*a* and 26*b*. Similarly, inner spline 24 includes a metal strip 30 wrapped around and substantially enclosing a foam core 32. Respective opposed ends of the metal strip 30 are formed in the shape of hooks 30*a* and 30*b*. Beads of an adhesive 28*a* and 28*b* are applied to the outer surface of metal strip 26 by means of an adhesive applicator 50. Similarly, adhesive beads 34*a* and 34*b* are applied to the outer surface of metal strip 30 as shown in FIG. 1. With the adhesive beads applied to the outer surface of each of the outer and inner splines 22, 24, the splines are inserted in aligned slots in the first and second panels 12, 14. Thus, outer spline 22 is inserted in aligned slots 16*a* and 18*a*, while inner spline 24 is inserted in aligned slots 16*b* and 18*b*. The tight fit of each spline in a respective slot causes its end hooks to securely engage adjacent portions of the foam cores of the first and second panels 12, 14. Thus, end hooks 26*a* and 26*b* of outer spline 22 respectively engage foam cores 12*c* and 14*c* of the first and second panels 12, 14. Similarly, end hooks 30*a* and 30*b* respectively engage the adjacent portions of foam cores 12*c* and 14*c* of first and second panels 12, 14. In this manner, each of the outer and inner splines 22, 24 securely couples the first and second panels 12, 14 by engaging their respective inner foam cores. This connection between the first and second panels 12, 14 is particularly important while the aforementioned adhesive deposits are curing. In order to provide more secure bonding between the outer and inner splines 22, 24 and the adhesive deposits 36, 38 respectively applied thereto, a coating of a laminators grade backer of epoxy is applied to each of the metal splines.

As shown in FIG. 2, the adhesive beads applied to the outer surface of the outer spline 22 are disposed between the spline and adjacent inner surfaces of the outer facings 12*a* and 14*a* of the first and second panels 12, 14 in the form of an adhesive layer 36. Similarly, when the inner spline 24 is inserted in aligned slots 16*b* and 18*b*, the adhesive beads 34*a* and 34*b* form an adhesive layer 38 between the inner spline and adjacent inner surfaces of the inner facings 12*b* and 14*b* of the first and second panels 12, 14. The facings of the first and second panels 12, 14 are comprised of conventional construction materials, such as plywood, oriented strand board, drywall, or composite gypsum. The adhesive deposits applied to each of the outer and inner splines 22, 24 securely join the first and second panels 12, 14.

Referring to FIG. 1*a*, there is shown a partial sectional view of another embodiment of a panel joining arrangement 40 in accordance with the principles of the present invention. The panel joining arrangement 40 connects a first panel 42 with a second panel (which is not shown in the figure for simplicity) in a manner similar to that described with regard to the embodiment shown in FIGS. 1, 2 and 3. As in the previously described embodiment, panel 42 includes a first facing 42*a*, a foam core 42*b*, and a second opposed facing (which also is not shown in the figure). A slot 42*c* is formed between the first facing 42*a* and foam core 42*b* along an edge of the panel 42. Slot 42*c* is adapted to receive one end of a spline 44, while an opposed end of the spline is adapted for insertion in a corresponding slot in an adjacent panel which is not shown for simplicity. Spline 44 includes a metal strip 46 and a foam strip 48. Adhesive deposits 52*a* and 52*b* are applied to the spline's metal strip for bonding to the outer facings of the two panels including facing 42*a* of panel 42. Spline 44 does not include the hook structures formed in the end portions of the spline's metal strip 46 as in the previously described embodiments. The adhesive securely bonds spline 44 to the two adjacent structural panels, while insulating strip 48 functions as a barrier to heat transfer between the opposed facings of the two panels.

Referring to FIG. 4, there is shown another embodiment of a panel joining arrangement 60 in accordance with the present invention. The panel joining arrangement 60 securely couples the first and second panels 62 and 64. As in the previously described embodiment, the first panel 62 includes outer and inner facings 62*a* and 62*b* and an insulating foam core 62*c*. Similarly, second panel 64 includes outer and inner facings 64*a* and 64*b* as well as an insulating core 64*c*. The panel joining arrangement 60 includes two different types of splines for securely connecting first and second panels 62, 64. The two different types of splines shown in FIG. 4 can be used either together in combination, or the panel joining arrangement may include both splines of the same type, either type being applicable to the present invention. As shown in FIG. 4, an outer spline 70 is in the form of a planar sheet of metal and is adapted for insertion in aligned slots 66*a* and 68*a* in the first and second panels 62, 64. The inner spline 72 is adapted for insertion in aligned slots 66*b* and 68*b* in the first and second panels 62, 64. Inner spline 72 includes opposed end hooks 72*a* and 72*b* extending along the respective edges of the spline. End hook 72*a* engages insulating core 62*c* when the inner spline 72 is inserted in slot 66*b*, while end hook 72*b* engages insulating core 64*c* when the inner spline is inserted in slot 68*b*. Each of the outer and inner splines 70 and 72 is intended for use with an adhesive for bonding the spline to either the outer or inner facing of the first and second panels 62 and 64 as in the previously described embodiments.

Figure 5:
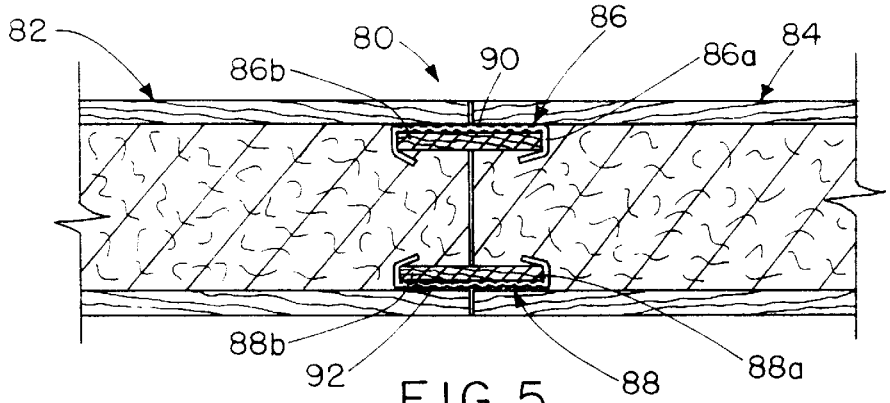
FIG. 5 is a partial sectional view showing a pair of structural panels connected together in accordance with another embodiment of the spline coupling arrangement of the present invention.
Figure 5A:
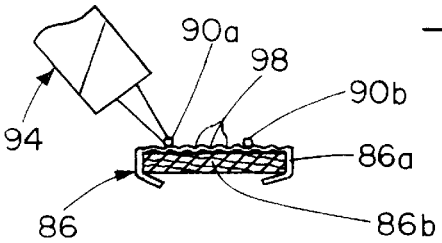
FIG. 5*a* is a transverse sectional view of a metal spline with a foam core in accordance with another embodiment of the present invention.
Figure 5B:
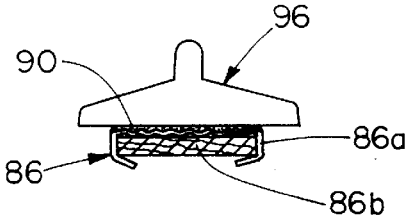
FIG. 5*b* is a transverse sectional view of the metal spline of FIG. 5*a* illustrating the manner in which adhesive deposits applied to the spline are uniformly spread over the spline in accordance with one aspect of the present invention for more secure bonding to the structural panels.

Referring to FIG. 5, there is shown yet another embodiment of a panel joining arrangement 80 in accordance with the present invention. Panel joining arrangement 80 securely connects first and second laminated, insulated panels 82 and 84. An outer spline 86 includes a metal strip 86*a* and an inner foam core 86*b*. Similarly, an inner spline 88 includes a metal strip 88*a* and an inner foam core 88*b*. Each of the outer and inner splines 86, 88 is inserted in aligned slots in each of the first and second panels 82, 84, with hook end portions in each of the splines securely engaging the insulating foam cores of the panels. Referring also to FIGS. 5*a* and 5*b*, which are transverse sectional views of the outer spline 86, additional details of the panel joining arrangement 80 in FIG. 5 will now be described. As shown in FIGS. 5*a* and 5*b*, the metal strip 86*a* disposed substantially about the foam core 86*b* of the outer spline 86 is provided with a plurality of spaced grooves 98. Several bead-like adhesive deposits 90*a* and 90*b* are applied to the outer surface of the metal strip 86*a* by means of an adhesive applicator 94 as shown in FIG. 5*a*. A trowel 96 is then used to level off the adhesive deposits in the form of an adhesive layer 90 on the surface of the metal strip 86*a*. The embossed, or undulating, surface configuration of the metal strip 86*a* provides a general uniform application of the adhesive layer 90 on the metal strip using trowel 96. The adhesive fills the low spots on the surface of the metal strip 86*a* and is spread in a general uniform manner over the entire surface of the metal strip. Where the adhesive is urethane-based, the adhesive will expand upon curing and spread out so as to uniformly fill the space between metal strip 86*a* and an adjacent portion of a panel facing. The generally uniform application of the adhesive layer 90 on the surface of the metal strip 86*a* provides improved bonding between spline 86 and an adjacent facing of the first and second panels 82 and 84 as shown in FIG. 5.

There has thus been shown an improved spline arrangement for joining structural panels. In the panel joining arrangement, a pair of splines each in the form of a thin metal strip are inserted in respective slots, or grooves, adjacent the facings of a pair of structural panels. An adhesive applied to the metal splines bonds the splines to the facings of each panel and securely connecting the two panels along respective abutting edges. In one embodiment, each metal strip is provided with opposed turned-in edges which function as hooks for engaging the foam core and preventing separation of the two panels, particularly during curing of the adhesive. In another embodiment, each spline further includes a foam insulating strip about which the spline's metal strip is substantially wrapped for providing a thermal barrier at the panel juncture. In yet another embodiment, the spline's metal strip is provided with an irregular surface such as grooved or embossed for more uniform application of the adhesive and a stronger bond between the spline and adjacent panels. By locating the pair of splines immediately adjacent the outer facings of both joined panels, an inner component at the panel juncture which is typically incorporated for additional strength is not required and the routing of electrical chases through the panel juncture is simplified. While particular embodiments of the present invention have been shown and described, it win be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. An arrangement for joining structural panels comprising:

first and second structural panels each having respective first and second opposed facings and an insulating foam core attached to and disposed between said facings, wherein adjacent facings of said first and second structural panels are arranged in abutting contact, each of said structural panels further including respective first and second slots in an edge thereof formed between said insulating foam core and a facing of the panel;

first and second metal splines each inserted in a respective slot and engaging an inner surface of a facing of each of said first and second structural panes; and adhesive means for bonding each of said first and second metal splines to an inner surface of a facing of each of said first and second structural panels.

2. The arrangement of claim 1 wherein said adhesive means is comprised of mastic, epoxy cement or urethane glue.

3. The arrangement of claim 1 wherein said metal splines are comprised of aluminum or galvanized steel.

4. The arrangement of claim 1 further comprising a laminators grade backer of epoxy applied to said first and second metal splines for improved bonding to said adhesive means.

5. The arrangement of claim 1 wherein said insulating foam core is comprised of plastic foam.

6.A coupling arrangement for connecting first and second generally planar structural panels, each of said structural panels including first and second opposed facings and an insulating foam core disposed intermediate and bonded to said first and second facings, said coupling arrangement comprising:

means for defining first and second slots disposed in adjacent edges of each of said first and second panels, wherein each of said slots is disposed intermediate the foam core and one of the facings of said panel;

first and second metal splines each having respective first and second end portions and extending substantially the entire length of said panels, wherein the first and second end portions of each of said metal splines are inserted in respective slots of said first and second panels and wherein adjacent facings of said first and second panels are arranged in abutting contact; and adhesive means for bonding the first and second ends of each of said metal splines to an inner surface of a respective facing of said first and second panels.

7. The coupling arrangement of claim 6 wherein each of said metal splines is comprised of aluminum or galvanized steel.

8. The coupling arrangement of claim 6 wherein said adhesive means is comprised of mastic, epoxy cement or urethane glue.

9.The coupling arrangement of claim 6 wherein said insulating foam core is comprised of plastic foam.

10. The coupling arrangement of claim 6 further comprising a laminators grade backer of epoxy applied to said first and second metal splines for improved bonding to said adhesive means.

* * * * *